US012179084B2

(12) United States Patent
Engel

(10) Patent No.: US 12,179,084 B2
(45) Date of Patent: Dec. 31, 2024

(54) RELEASABLE NET APPARATUS AND SYSTEM

(71) Applicant: Joseph C. Engel, Bakersfield, CA (US)

(72) Inventor: Joseph C. Engel, Bakersfield, CA (US)

( * ) Notice: Subject to any disclaimer, the term of this patent is extended or adjusted under 35 U.S.C. 154(b) by 325 days.

(21) Appl. No.: 16/816,890

(22) Filed: Mar. 12, 2020

(65) Prior Publication Data

US 2021/0283486 A1 Sep. 16, 2021

(51) Int. Cl.
*A63B 71/02* (2006.01)

(52) U.S. Cl.
CPC ..... *A63B 71/022* (2013.01); *A63B 71/023* (2013.01); *A63B 2209/00* (2013.01)

(58) Field of Classification Search
CPC .. A47C 7/22; A47C 31/04; A47C 4/30; E06B 9/48; A63B 71/022; A63B 71/023; A63B 2209/00; F16B 31/00; F16B 9/02; F16B 31/005; F16B 31/007; F16B 31/021; F16B 45/035; F16B 45/036; F16B 45/037; F16B 45/04; F16B 45/057; F16B 45/043; F16B 45/045; F16B 45/047; F16B 45/049; F16B 45/051; F16B 45/053; F16B 45/055; F16B 45/059; B25B 23/1415
See application file for complete search history.

(56) References Cited

U.S. PATENT DOCUMENTS 1,818,813 A * 8/1931 Netz ..... B66C 1/34 24/698.1
4,014,521 A * 3/1977 Berman ..... E04H 17/00 473/494
4,067,282 A * 1/1978 Guinn ..... B63B 21/22 114/293
4,517,913 A * 5/1985 Albertini ..... B63B 21/20 114/294
4,605,204 A * 8/1986 Schmanski ..... E01F 15/065 404/10
4,733,625 A * 3/1988 Allen ..... F16G 15/04 114/247
4,751,892 A * 6/1988 Sechel ..... B63B 21/00 114/221 R
4,903,638 A * 2/1990 Lacey ..... A01K 27/005 119/776
5,029,819 A * 7/1991 Kane ..... E01F 13/028 160/24

(Continued)

*Primary Examiner* — Melba Bumgarner
*Assistant Examiner* — Amir A Klayman
(74) *Attorney, Agent, or Firm* — Cohen IP Law Group, PC; Michael N. Cohen

(57) ABSTRACT

A releasable net system using a releasable net attachment mechanism is provided. The releasable net system includes two or more upright structures with lateral support structures extending therebetween, and at least one net configured with the lateral support structures to form a net wall. The at least one net is attached to the lateral support structures using one or more releasable attachment mechanisms that are adapted to break under a predetermined load. In this way, the releasable attachment mechanisms may release the net from the support structures under environmental load conditions (high winds, snow, freezing rain) prior to the collapse of the support structures. The system may be used with outdoor netting systems such as those used for errant ball containment at golf driving ranges.

14 Claims, 12 Drawing Sheets

(56) References Cited

U.S. PATENT DOCUMENTS 5,122,007 A * 6/1992 Smith ..... H02G 1/08 403/379.5
5,180,143 A * 1/1993 Brower ..... A63C 19/06 256/19
5,271,449 A * 12/1993 Herrick ..... E06B 9/521 160/354
5,287,614 A * 2/1994 Ehrlich ..... A47G 11/006 5/493
5,292,165 A * 3/1994 Wiklund ..... B66C 1/38 294/82.2
5,301,925 A * 4/1994 Carlson ..... E01F 9/685 256/13
5,329,675 A * 7/1994 McLean ..... F16B 45/02 24/599.6
5,407,178 A * 4/1995 Long ..... E01F 13/028 160/354
5,461,821 A * 10/1995 Carter, Jr. ..... A01K 95/00 43/43.12
5,538,303 A * 7/1996 Dunham ..... B63B 21/54 294/82.19
5,913,670 A * 6/1999 Anderson ..... A01K 69/06 43/4.5
5,924,469 A * 7/1999 Whittemore ..... E04G 21/30 248/200.1
6,176,471 B1 * 1/2001 Naegele ..... E04H 17/161 256/65.02
6,223,372 B1 * 5/2001 Barber ..... B25F 1/00 7/118
6,308,383 B1 * 10/2001 Schrader ..... F16G 11/00 24/598.5
6,343,778 B1 * 2/2002 Brown ..... E01F 15/0415 256/10
6,382,583 B1 * 5/2002 Hill, III ..... E01F 9/635 174/40 TD
6,450,558 B1 * 9/2002 Ringrose ..... B63B 21/54 24/600.1
6,457,896 B1 * 10/2002 deDoes ..... A01K 27/005 403/164
6,564,500 B1 * 5/2003 Ames ..... A01K 91/047 43/43.12
6,654,990 B2 * 12/2003 Liu ..... F16B 45/021 24/598.5
6,671,933 B1 * 1/2004 Friend ..... F16G 15/08 24/115 F
6,824,122 B2 * 11/2004 Spyrakis ..... E04H 17/00 256/19
7,000,323 B1 * 2/2006 Hatcher ..... B25F 1/04 30/155
D520,345 S * 5/2006 Kelleghan ..... D8/356
D521,362 S * 5/2006 Kelleghan ..... D8/356
7,126,484 B1 * 10/2006 Luquire ..... B26B 1/10 7/168
7,134,526 B2 * 11/2006 Bradley ..... A63B 71/022 182/138
7,175,548 B2 * 2/2007 McNulty ..... A63B 71/022 473/421
7,320,353 B1 * 1/2008 Miller ..... E06B 3/80 160/368.1
7,389,750 B1 * 6/2008 Rogers ..... A01K 27/005 119/792
7,455,603 B2 * 11/2008 Bouffard ..... A63B 63/004 473/492
D590,237 S * 4/2009 Parisi ..... D8/356
7,665,839 B1 * 2/2010 Tedeschi ..... F16B 31/00 351/52
7,698,970 B1 * 4/2010 Chavez ..... B25B 15/005 7/138
7,743,597 B2 * 6/2010 Shnayder ..... F16G 15/10 43/4.5
7,841,378 B2 * 11/2010 Henning ..... E01F 7/025 160/368.1
D632,546 S * 2/2011 Schmid ..... D8/356
8,038,171 B2 * 10/2011 Bailey ..... A63C 5/16 280/817
8,327,788 B1 * 12/2012 Cardarelli ..... B63B 21/54 114/221 R
8,480,690 B2 * 7/2013 Vijayanagar ..... A61B 17/06061 24/598.2
8,572,819 B2 * 11/2013 Yang ..... F16B 45/02 24/600.1
8,573,565 B1 * 11/2013 Lyndaker ..... E04H 17/02 256/45
8,966,690 B2 * 3/2015 Stokes ..... H02G 1/1204 7/129
9,038,777 B2 * 5/2015 Stearns ..... A62B 1/22 182/138
9,180,535 B2 * 11/2015 Vanderbeek ..... B25F 1/04
9,284,181 B1 * 3/2016 Nieslanik ..... A01K 27/005
9,427,858 B2 * 8/2016 Duncan ..... B25F 1/04
D765,495 S * 9/2016 Schmid ..... D8/356
9,599,145 B2 * 3/2017 Durfee ..... F16B 1/00
9,631,771 B1 * 4/2017 Abels ..... F21L 4/00
D807,725 S * 1/2018 Chalfant ..... D8/105
9,975,234 B2 * 5/2018 Berman ..... B25F 1/00
D827,418 S * 9/2018 Austin ..... D8/356
10,081,955 B2 * 9/2018 Whittemore ..... E04G 21/30
10,112,293 B2 * 10/2018 Cheng ..... B25B 15/008
10,145,408 B2 * 12/2018 MacArthur ..... F16B 45/04
D847,616 S * 5/2019 Spater ..... D8/367
D881,681 S * 4/2020 Mojica ..... D8/356
10,611,012 B2 * 4/2020 Adelman ..... B25F 1/00
10,701,903 B1 * 7/2020 Cesta ..... G08B 21/22
D918,692 S * 5/2021 Adelman ..... D8/356
11,208,299 B2 * 12/2021 Betzler ..... B66C 1/14
D942,840 S * 2/2022 Adelman ..... D8/367
D943,400 S * 2/2022 Adelman ..... D8/367
D947,652 S * 4/2022 Noble ..... D8/356
D948,996 S * 4/2022 Misener ..... D8/367
2004/0200126 A1 * 10/2004 Ames ..... A01K 69/00 43/43.12
2005/0109998 A1 * 5/2005 Sadinsky ..... E04H 4/06 256/25
2005/0144730 A1 * 7/2005 Barber ..... B25B 7/22 7/138
2005/0229367 A1 * 10/2005 Thompson ..... F16B 45/037 24/599.9
2007/0138456 A1 * 6/2007 Clark ..... E01F 13/028 160/368.1
2008/0104802 A1 * 5/2008 Vermillion ..... A45F 5/021 24/3.12
2008/0226411 A1 * 9/2008 McKinlay ..... B60B 3/16 411/43
2015/0197022 A1 * 7/2015 Pelton ..... B26B 11/00 30/153
2015/0231423 A1 * 8/2015 Perner ..... A62B 35/0037 24/518
2016/0153487 A1 * 6/2016 Hollinger ..... F16B 45/02 24/492
2016/0215812 A1 * 7/2016 Durfee ..... A01K 27/005
2016/0255908 A1 * 9/2016 Rentko, II ..... A43B 1/0081
2016/0376129 A1 * 12/2016 Hendrix ..... B66C 1/36 294/82.2
2017/0056702 A1 * 3/2017 Carter ..... A63B 21/0442
2017/0268717 A1 * 9/2017 Roskamp ..... F16M 13/02
2022/0018384 A1 * 1/2022 Adelman ..... A44B 15/00

* cited by examiner

RELEASABLE NET APPARATUS AND SYSTEM

COPYRIGHT STATEMENT

This patent document contains material subject to copyright protection. The copyright owner has no objection to the reproduction of this patent document or any related materials in the files of the United States Patent and Trademark Office, but otherwise reserves all copyrights whatsoever.

FIELD OF THE INVENTION

This invention relates to netting systems including releasable netting systems.

BACKGROUND

Outdoor netting systems (e.g., net walls) are used for protection throughout the world in different environments. One well-known example of this includes the use of netting systems with outdoor golf driving ranges to protect the areas adjacent the driving ranges from errant golf balls. These implementations may be referred to as errant golf ball containment structures. Similar types of containment structures are used at baseball fields, soccer fields, football fields, areas where unmanned aerial vehicles (UAVs, drones) may frequent for fugitive dust and trash containment or to visually obscure sites, and other types of structures.

The containment structures may typically include nets bounded by ropes attached to steel cables extending between tall steel poles. The poles may be embedded in concrete foundations and extend upward to heights of 170' above finished grade. In this way, the structures may be sturdy and sufficiently tall to capture or otherwise block errant objects (e.g., golf balls) from entering into neighboring areas.

However, many of these outdoor structures may be implemented in areas with potentially severe weather conditions that may adversely affect the structures. For example, in winter storms, snow and ice may freeze to the netting thereby increasing the weight supported by the steel cables and poles. In addition, as the netting becomes laden with ice and snow, the porosity of the net may be greatly reduced resulting in increased wind drag. High winds associated with freezing rain coupled with the ice buildup on the nets may cause a significant increase to the horizontal loads applied to the structure, and in extreme conditions, may cause the poles to be overloaded and to collapse.

Once collapsed, the poles must be replaced, and the structure must be rebuilt resulting in lost revenues and a high cost of repair.

Accordingly, there is a need for a releasable net apparatus and system that may release the nets upon potential overloading of the support poles prior to the catastrophic collapsing of the poles. In this way, the nets may be released under severe weather conditions and the poles may be left standing. The cost and effort necessary to restring the nets onto the standing poles may be far less than that of replacing the poles, thereby saving time and money.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EXEMPLARY EMBODIMENTS

In general, the system and associated apparatuses according to exemplary embodiments hereof provide releasable netting systems. In some embodiments, the releasable netting systems are adapted for use as outdoor containment structures (e.g., golf driving range errant ball containment screens, baseball fields, soccer fields, football fields, etc.) or for other purposes. In some embodiments the system includes two or more ground-based support structures (e.g., anchored columns, poles, etc.) adapted to vertically support nets therebetween to form a net wall.

In some embodiments, the nets may be peripherally bounded by ropes for support, and the ropes may be configured (clipped) to horizontal support cables running between the upright support structures. In this way, the nets may be strung between the upright support structures to form the net walls.

Figure 1:
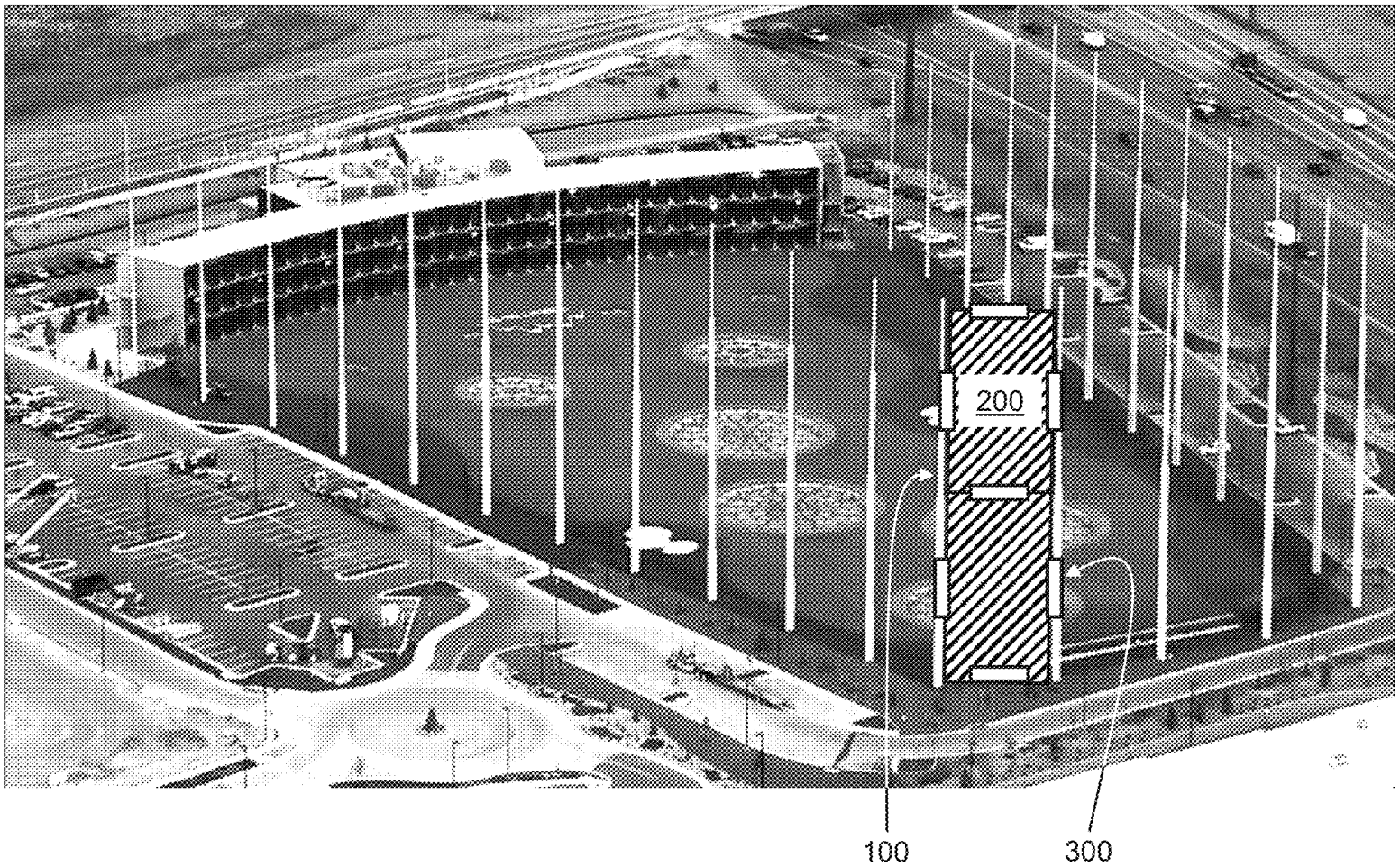
FIG. 1 shows aspects of a netting system according to exemplary embodiments hereof.

In one exemplary embodiment hereof as shown in FIG. 1, the system 10 includes a support assembly 100, a net assembly 200 and an attachment assembly 300. In general, the support assembly 100 may provide support to the net assembly 200, with the net assembly 200 attached to the support assembly 100 via the attachment assembly 300. The attachment assembly 300 may be adapted to release the net assembly 200 under predetermined environmental load conditions while generally leaving the support assembly 100 intact. The system 10 also may include other elements and components as necessary to perform its desired functionalities as described herein or otherwise.

Support Assembly 100

Figure 2:
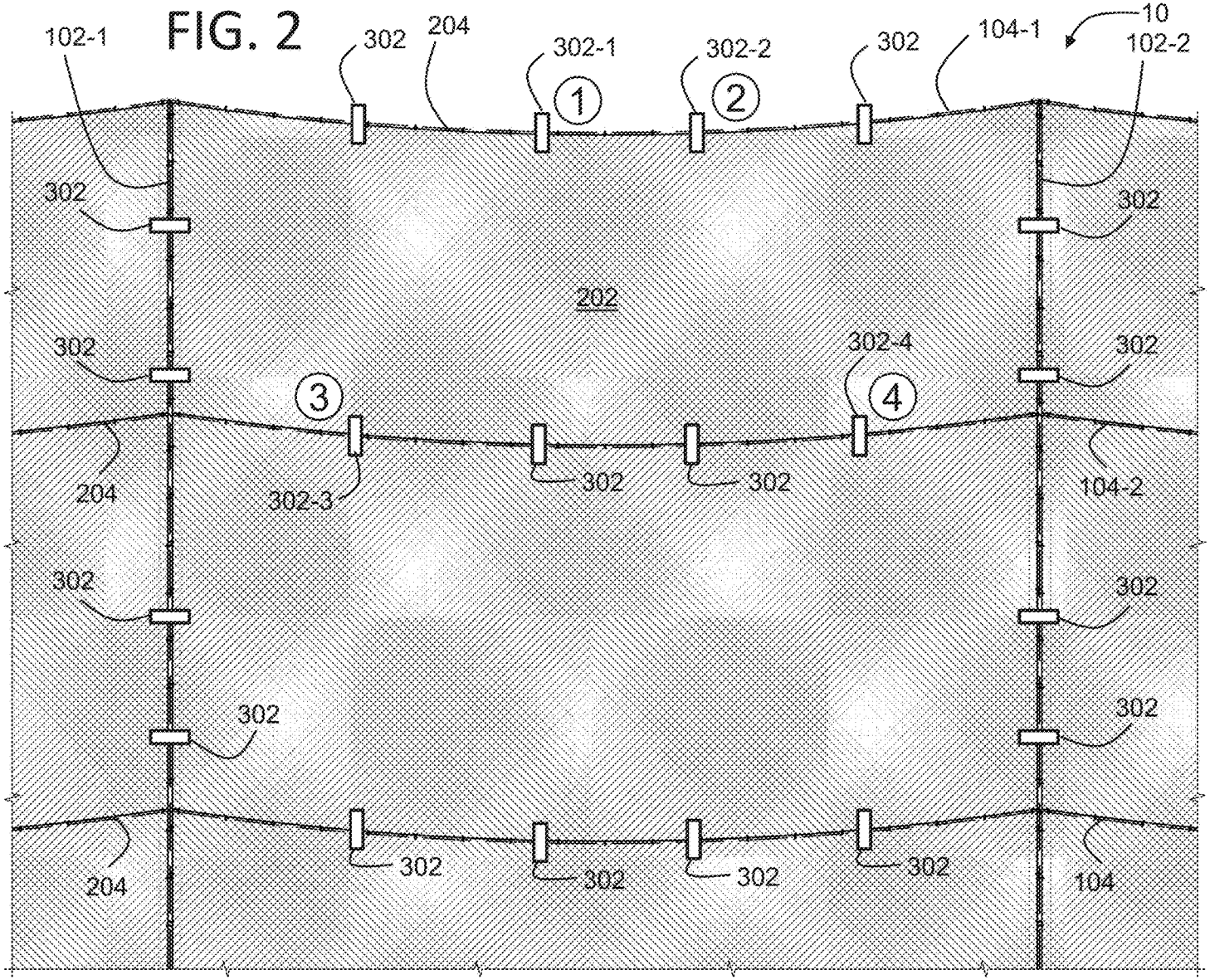
FIGS. 2-4 depict close-up views of aspects of the netting system of FIG. 1.

In one exemplary embodiment hereof as shown in FIG. 2, the support assembly 100 includes two or more upright support structures 102 and one or more lateral supports 104 extending therebetween.

In some embodiments, the upright support structures 102 may include poles, truss towers, lattice towers and/or other types of columns. In some embodiments the support structures 102 may be anchored in ground foundations (e.g., concrete) and/or guyed with cables for increased stability. The structures 102 may comprise steel, wood, composite materials (e.g., carbon composites), other types of materials and any combination thereof. In some implementations, the structures 102 may extend upward distances up to 90', 130', 170' and above. The diameter(s) of the structures 102 may be fixed and/or tapered and may be chosen to provide sufficient support to the system 10. The structures 102 may be generally vertical and/or may include portions or sections at other angles (e.g., diagonal cross bars).

In some embodiments, the lateral supports 104 may include cables, chains, cords, ropes and/or other types of supports that may extend between the upright structures 102. For example, in one implementation, the lateral supports 104 may include steel cables. As shown in FIG. 2, the lateral supports 104 may generally include a first end attached to a first upright support structure 102-1 and a second end of the attached to an adjacent second upright structure 102-2. The first and/or second ends of the lateral supports 104 may be attached at various positions on the upright structures 102 depending on the design of the structure (e.g., at the top, at intermediate positions, near the bottom, etc.). It is understood that the lateral structures 104 may extend continually between a plurality of adjacent upright structures 102 and that the ends of the lateral structures 104 may or may not terminate at any particular upright structure 102 depending on the design of the overall system 10.

As will be described in other sections and as shown in FIG. 2, the net assembly 200 may be attached to the lateral supports 104 and thereby be held between the upright structures 102. Accordingly, it is preferable that the lateral support structures 104 comprise materials of adequate strength to support the net assembly 300. For example, in some embodiments the lateral structures 104 may comprise 5/16" galvanized extra high strength (EHS) steel strands or other comparable structures.

In some embodiments, the support assembly 100 may include a lateral support 104 generally extending between the tops of adjacent upright support structures 102, and one or more lateral supports 104 extending between the upright structures 102 at intermediate locations between the ground and the tops of the structures 102. While FIG. 2 depicts one top lateral support 104-1 and one intermediary lateral support 104-2, it is understood that the system 10 may include any number of lateral supports 104 extending between any number of upright supports 102, and that the scope of the system 10 is not limited in any way by the number and/or location of lateral supports 104 and/or upright supports 102.

Net Assembly 200

In one exemplary embodiment hereof, the net assembly 200 includes one or more nets 202 attached to the support assembly 100 to form a net wall. In some embodiments, the nets 202 include polymer nets 202 comprising polypropylene, polyethylene, Kevlar, nylon, textiles, plastic, rubber, steel (e.g., chain link), other materials and any combination thereof. The nets 202 may include a cord diameter, mesh size and strength profile per design requirements so that the nets 202 may perform their desired functionalities. It also may be preferable that the nets 202 include UV protective treatments.

Figure 3:
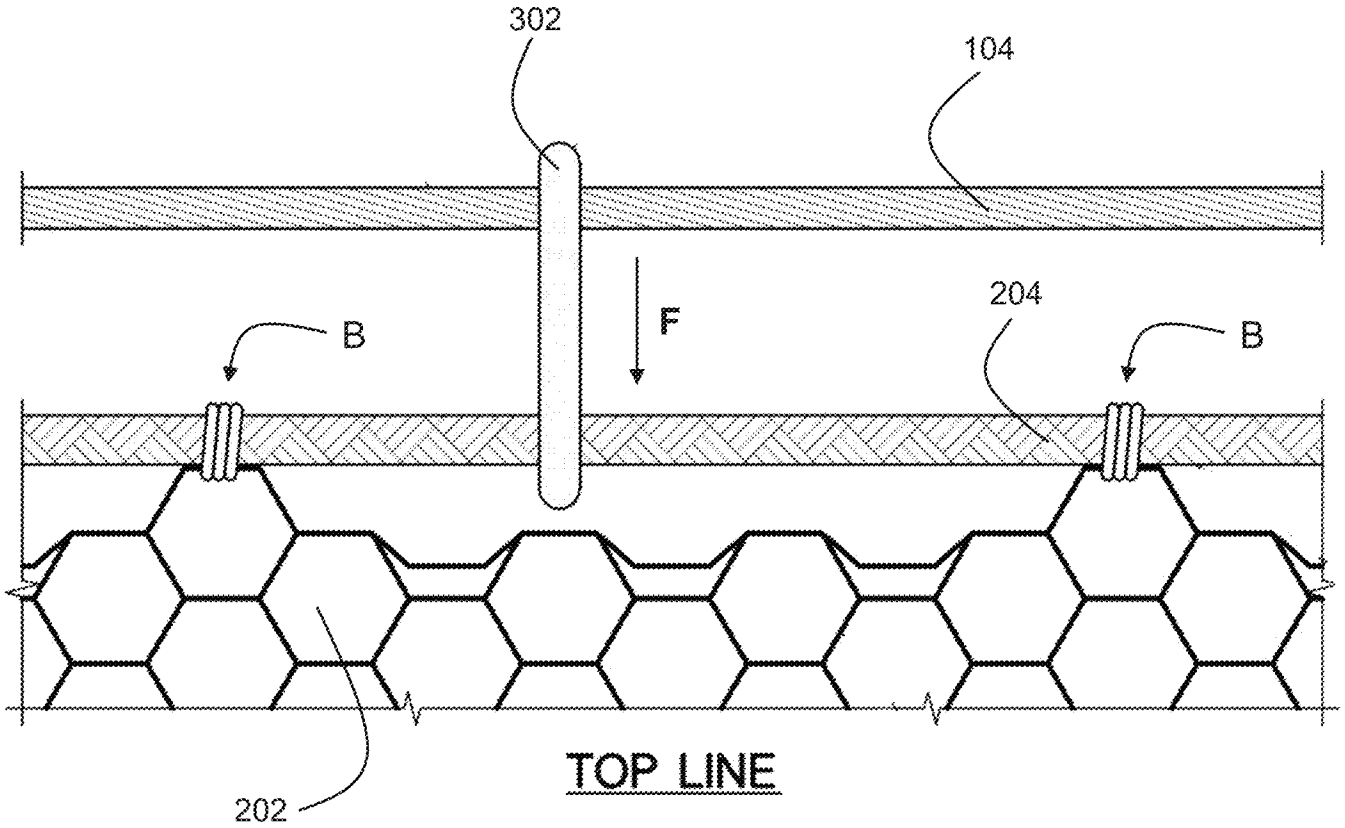
Figure 4:
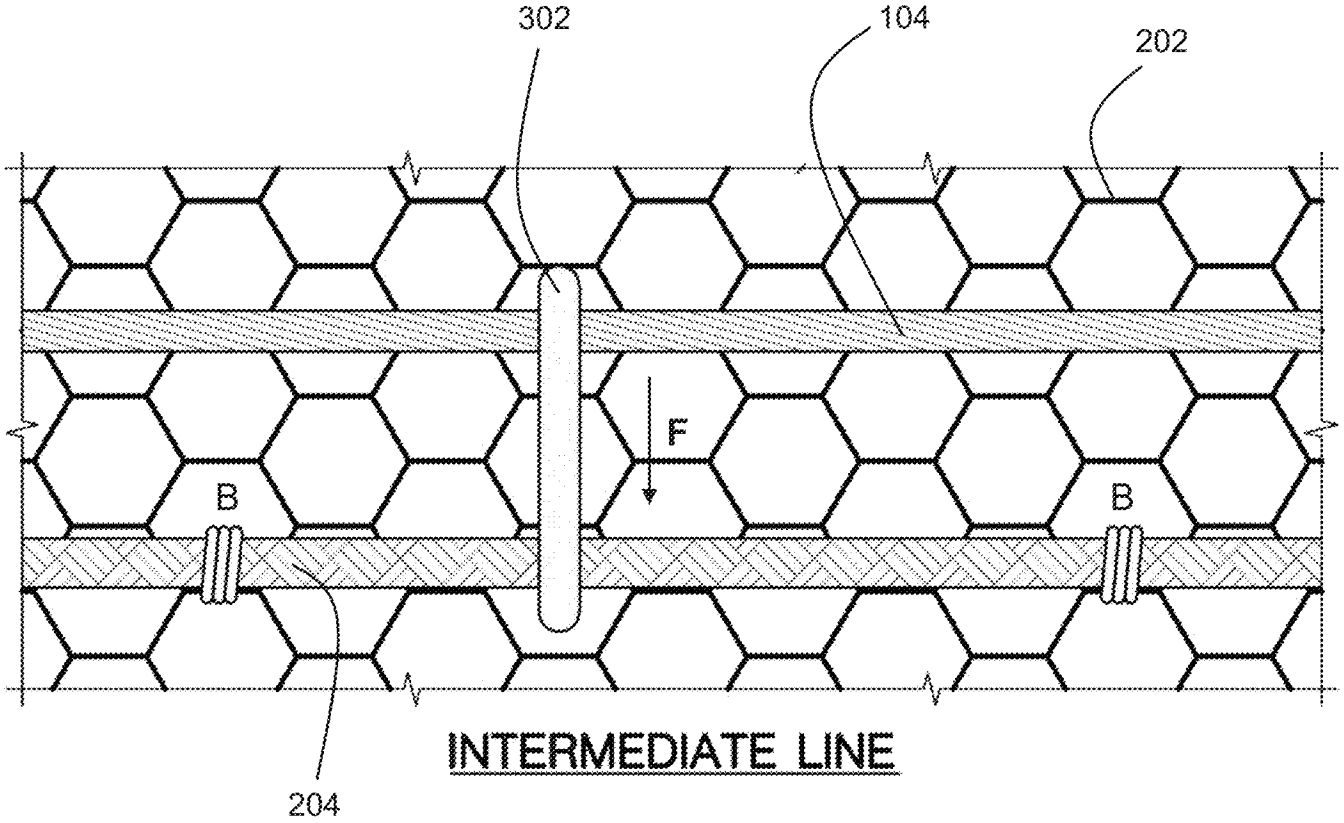

The nets 202 may be bound to support members 204 to provide strength and support to the nets 202. For example, FIG. 3 shows the top edge of a net 202 bound to a top edge rope 204 and FIG. 4 shows a middle portion of a net 202 bound to an intermediate rope 204. In some embodiments, the rope borders 204 may comprise 3/8" braided rope with #24 twisted nylon twine sewn to the netting 202 with half clove hitch at 7" intervals. Other materials and/or methods also may be used to attach the netting 202 to the rope border 204. It may be preferable that the support members 204 extend the length of each net 202 between the upright support structures 102 to provide continual support across each net 202 between the structures 102.

In some embodiments, a single net 202 may extend between two or more adjacent upright support structures 102, while in other embodiments, a plurality of nets 202 may be combined to extend between adjacent upright structures 102.

Attachment Assembly 300

In one exemplary embodiment hereof, the attachment assembly 300 is used to attach the net assembly 200 to the support assembly 100. In some embodiments, the attachment assembly 300 includes one or more attachment mechanisms 302 that may include one or more clips, fasteners, carabiners, shackles, rings, hoops, loops, grommets, other types of attachment members and any combination thereof. The shape of the attachment mechanism 302 may be generally circular, oval shaped, square, rectangular, tear shaped, any other types of shapes and any combination thereof. For example, the attachment mechanism 302 may include a generally oval or tear shaped hoop.

Figure 5B:
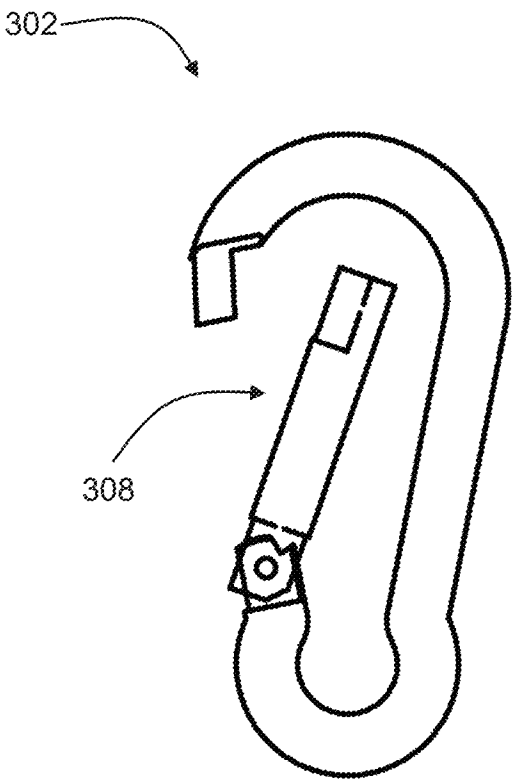
FIG. 5A-5B show aspects of an attachment mechanism according to exemplary embodiments hereof.
Figure 5A:
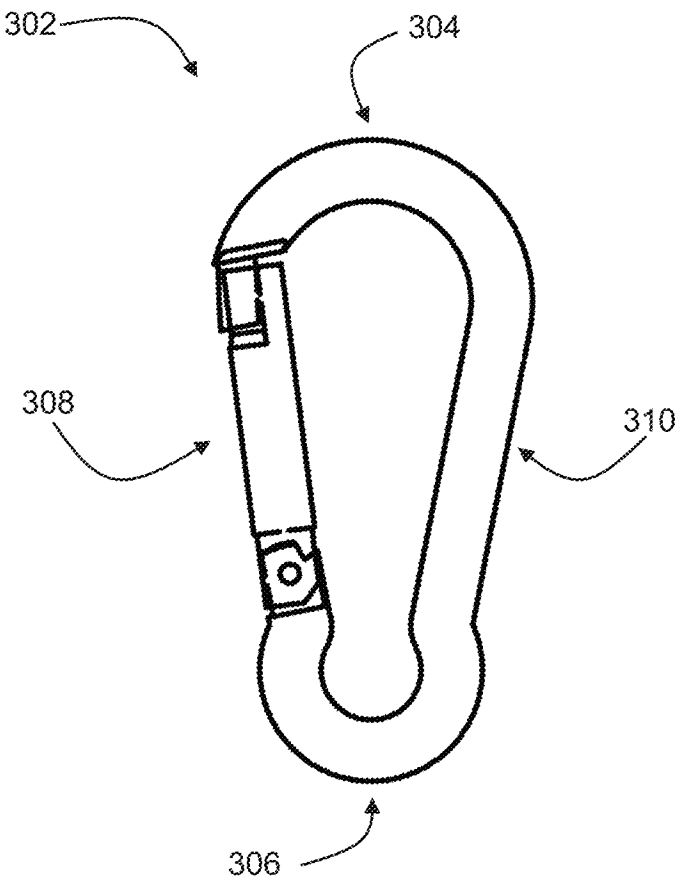

In one example as shown in FIGS. 5A and 5B, the attachment mechanism 302 resembles a carabiner or other type of hoop fastener with a top 304, a bottom 306, a spring-loaded hinged gate 308 and a closed side arm 310. FIG. 5A depicts the mechanism 302 with the gate 308 closed and FIG. 5B depicts the mechanism with the gate 308 open. In some embodiments, the gate 308 may include a non-locking gate 308 so that the top 304 of the attachment mechanism 302 may not be locked within the gate 308, but instead may be simply held and supported. In this way, as will be described in other sections, the top 304 may be free to rotate upward and out of the gate 308 as required.

In some embodiments, the attachment mechanism 302 may comprise high durability 5/16" carbon steel with smooth rounded edges that may not adversely wear the rope borders 204 and/or nets 202 to which the attachment mechanism 302 may be attached.

In some embodiments, each attachment mechanism 302 may attach a particular portion of a net 202 to a corresponding position along a lateral support structure 104. For example, as shown in FIG. 2, a first attachment mechanism 302-1 may be used to attach a portion of a net 202 to a lateral support structure 104-1 at position (1), a second attachment mechanism 302-2 may be used to attach a portion of the net 202 to a lateral support structure 104-1 at position (2), a third attachment mechanism 302-3 may be used to attach a portion of the net 202 to a lateral support structure 104-2 at position (3), and a fourth attachment mechanism 302-4 may be used to attach a portion of the net 202 to a lateral support structure 104-2 at position (4). In some embodiments, the attachment between each net 202 and each lateral support structure 104 may include attaching the support member 204 configured with the net 202 to the lateral support structure 104 at the desired location of the attachment. In other embodiments, the attachment between each net 202 and each lateral support structure 104 may include attaching the net 302 (e.g., the mesh) directly with the lateral support structure 104 at the desired location of the attachment.

As shown, positions (1) and (2) may be along the top edge of the net 202 and may attach the top edge of the net 202 (e.g., an upper support member 204 configured with the top edge of the net 202) to the top lateral support 104-1, and positions (3) and (4) may be along an intermediate (middle) portion of the net 202 (e.g., an intermediate support member 204 configured with an intermediate portion of the net 202) and may attach the middle portion of the net 202 to an intermediate (middle) support structure 104-2. It is understood by a person of ordinary skill in the art that these configurations of the net 202 with lateral supports 104-1, 104-2 at positions (1), (2), (3) and (4) are meant for demonstration and that the net 202 may be attached to other later supports 104 at other positions, and that the scope of the system 10 is not limited in any way by the number and/or location of attachments between the net 202 and the lateral supports 104.

FIG. 3 shows a close-up schematic of a net 202 with a top edge bound to a support member 204 (e.g., bound to a rope at points B), and the support member 204 attached to a lateral support 104 using an attachment mechanism 302. As environmental forces (wind, frozen rain, snow, etc.) pull the net 202 and its accompanying support member 204 away from the lateral support 104, these forces may be represented as a force vector F as shown.

FIG. 4 shows a close-up schematic of a net 202 with a middle portion bound to a support member 204 (e.g., bound by a rope at points B), and the support member 204 attached to a lateral support 104 using an attachment mechanism 302.

Figure 6:
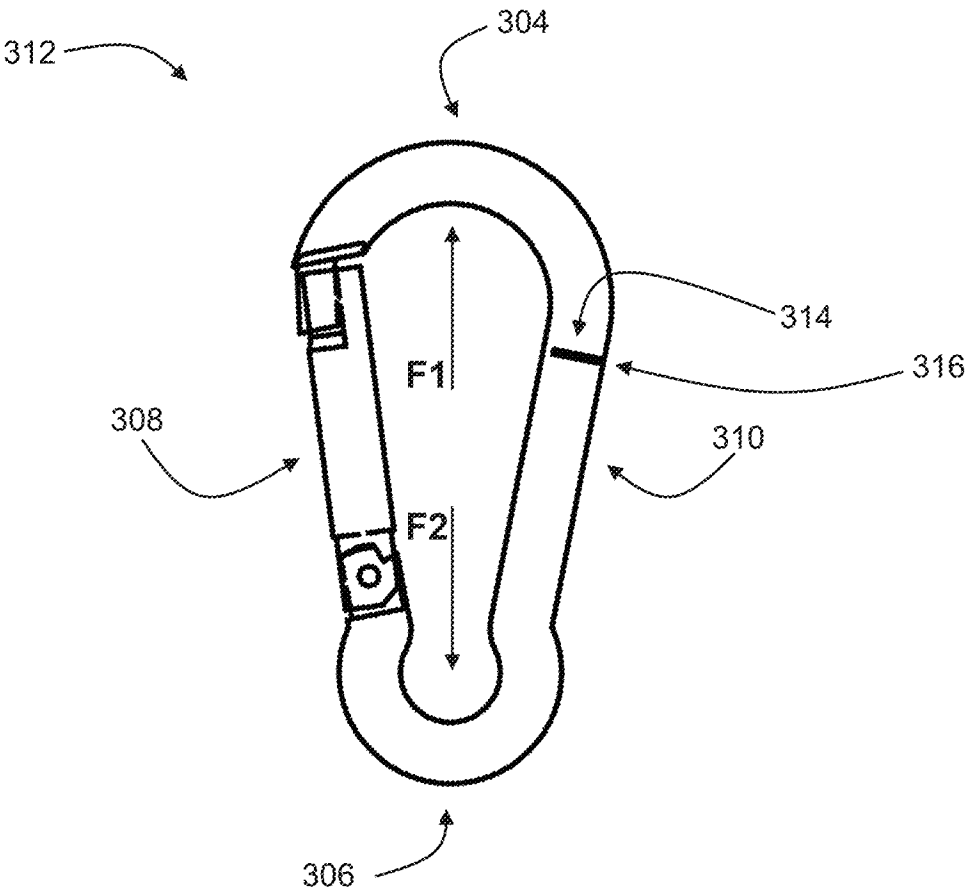
FIG. 6 shows aspects of a releasable attachment mechanism according to exemplary embodiments hereof.

In one exemplary embodiment hereof as shown in FIG. 6, the attachment mechanism 302 may include a releasable attachment mechanism 312. In some embodiments, the releasable attachment mechanism 312 may include an attachment mechanism 302 adapted to open, release or otherwise disengage under particular pre-determined conditions. For example, the releasable attachment mechanism 312 may be designed to break open when a specific amount of force F is applied to the mechanism 312. In this way, the releasable attachment mechanism 312 may be referred to as a "break-away" attachment mechanism 312. For example, an upward force F1 may be applied to the top 304 of the mechanism 312 and/or a downward force F2 may be applied to the bottom 306 of the mechanism 312, and the mechanism 312 may be designed to break open when the forces F1 and/or F2 exceed a predetermined force threshold.

In one exemplary embodiment hereof, the releasable attachment mechanism 312 includes at least one weakening element 314. For example, as shown in FIG. 6, the weakening element 314 may include a slot 316 that passes through at least a portion of the mechanism's side arm 310 thereby weakening the arm 310 in the general area of the slot 316. Using the orientation of the releasable attachment mechanism 312 as shown in FIG. 6, the slot 316 may pass from outside the mechanism 312 on the right and through the side arm 310 towards the left (towards the mechanism's median plane).

Figure 7B:
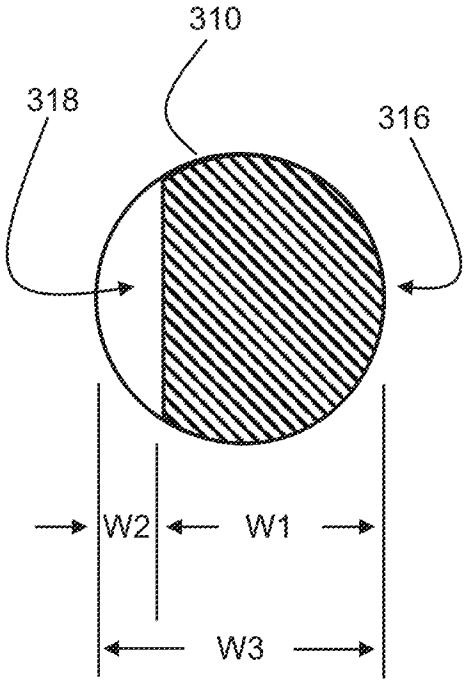
FIGS. 7A-7B show aspects of a weakening element according to exemplary embodiments hereof.
Figure 7A:
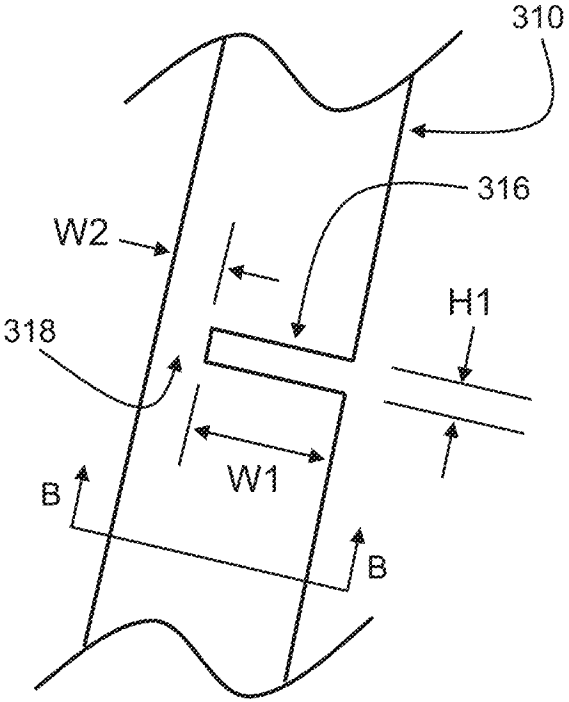

FIG. 7A shows a closeup schematic of the slot 316 within the side arm 310 of the mechanism 312 of FIG. 6. The slot 316 may include a height of H1 and a width of W1. Because the slot 316 may not pass entirely through the side arm 310, a remaining portion of material 318 (also referred to as the bridge 318) may include a width of W2. In general, the width W1 plus the width W2 equals the diameter W3 of the side arm 310.

FIG. 7B shows the cross section of the slot 316 and the bridge 318 taken from the perspective of cut-lines B-B in FIG. 7A.

Figure 8:
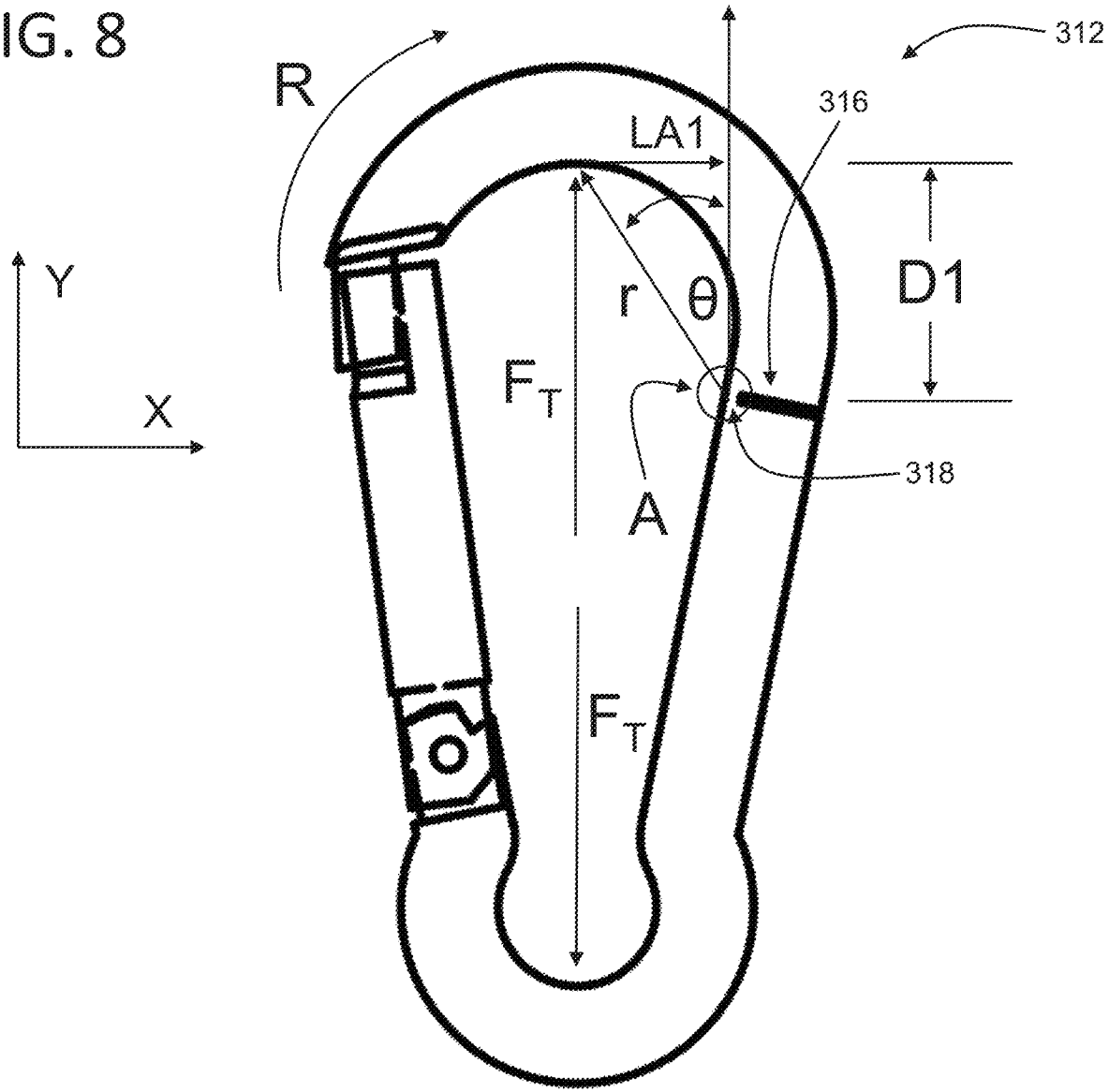
FIG. 8 shows aspects of a releasable attachment mechanism according to exemplary embodiments hereof.

In one exemplary embodiment hereof as shown in FIG. 8, the upward (and downward) force $F_T$ (i.e., a tension force representing all forces applied to the mechanism 312) of sufficient magnitude applied to the top 304 of the releasable attachment mechanism 312 causes a predictable break-away of the attachment mechanism 312 in the area of the weakening element 314. Accordingly, the releasable attachment mechanism 312 may be designed to break (and thereby release) at a specific breaking force $F_B$. That is, by knowing the breaking force $F_B$ at which the releasable attachment mechanism 312 is desired to break, the dimensions and position of the slot 316 may be designed to facilitate such breakage.

As shown in FIG. 8, the upward force $F_T$ applied to the top 304 may be modeled as a torque $\tau$ applied to the top 304 about an axis of rotation A centered at the bridge 318. With the slot 316 positioned at a vertical distance D1 from the point of force, the torque $\tau$ may generally be given by:

$$\tau = r\, F_T \sin \Theta$$

Where:

$\tau$ is the applied torque;

r is the distance from the axis of rotation to the point of force;

F is the applied force; and $\Theta$ is the angle between $F_T$ and r

The lever arm LA1 is also shown as the perpendicular distance from the axis of rotation A to the line of action of the upward force $F_T$.

Figure 9:
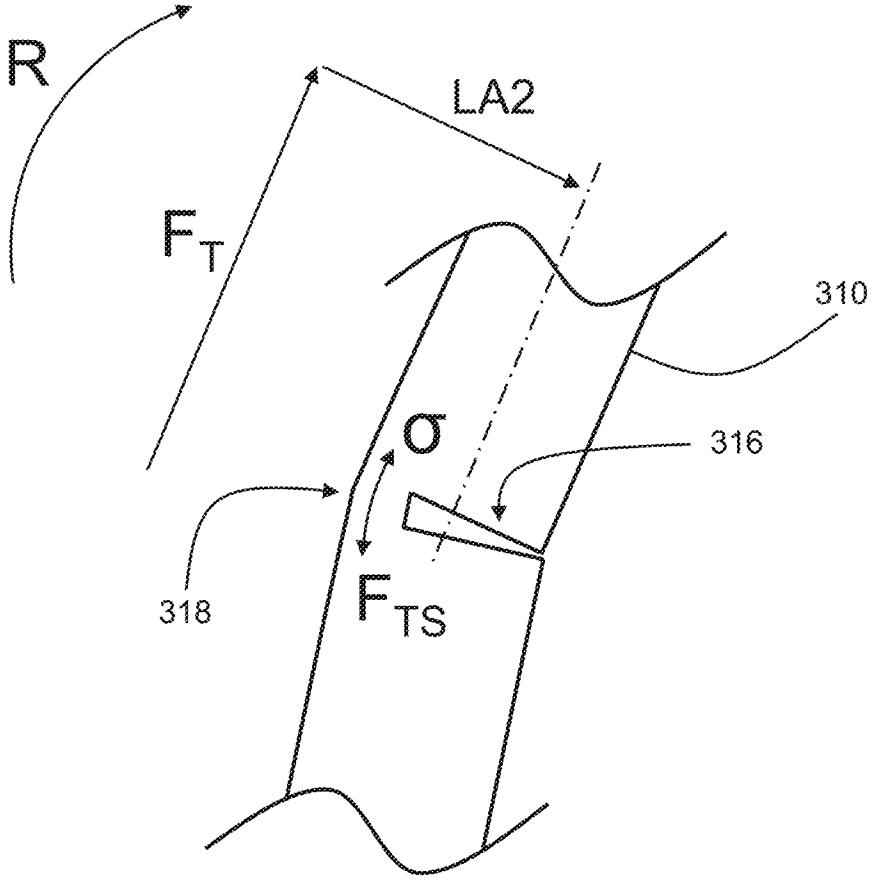
FIG. 9 shows aspects of a weakening element according to exemplary embodiments hereof.

As the upward force $F_T$ is applied, the torque $\tau$ causes the top 304 of the releasable attachment mechanism 312 to begin rotating in a generally clockwise direction as represented by R about the axis of rotation A (centered at the bridge 318). Because the gate 308 is non-locking, the top 304 may be free to rotate upward and out of the gate 308 without obstruction. This in turn may cause the slot 316 to collapse as shown in FIG. 9 causing the axis of rotation A to jam. As the torque $\tau$ continues and with the axis of rotation A jammed, the lever arm relocates to the slot 316 and bridge 318 portion (as represented as LA2) and a tensile force $F_{TS}$ is applied to the bridge 318 as shown. This force $F_{TS}$ may cause an associated tensile stress $\sigma$ within the material at the bridge 318.

As is known in the art, a stress $\sigma$, which is a force applied to a per unit area of a material (e.g., to the area of the bridge 318), produces a stretching of the area (e.g., of the bridge 318) referred to as a strain E. Strain is represented by the ratio of the difference in length $\Delta L$ caused by the stress $\sigma$ to the original length $L_0$ along the direction of the stress $\sigma$, i.e., $\epsilon = \Delta L / L_0$.

Figure 10B:
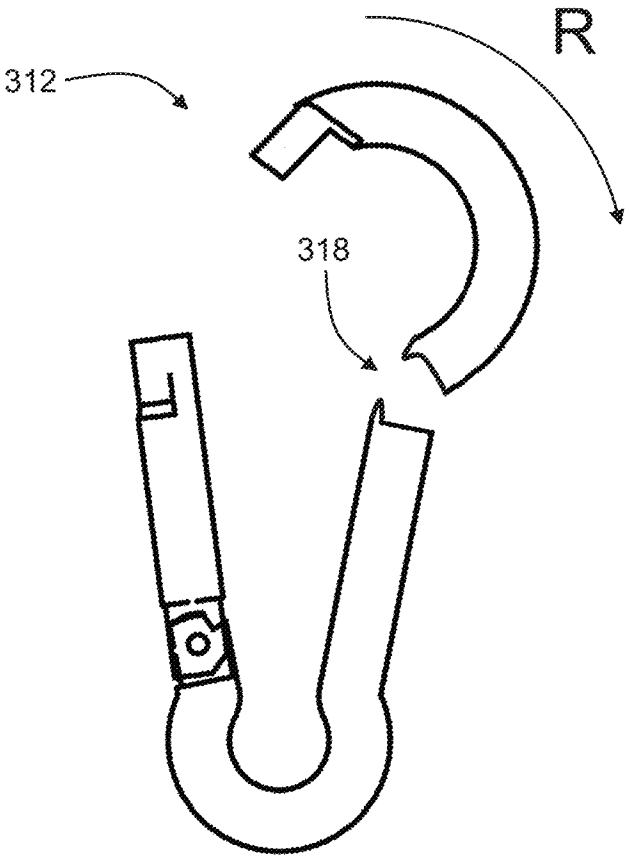
FIGS. 10A-10B show aspects of a releasable attachment mechanism according to exemplary embodiments hereof.
Figure 10A:
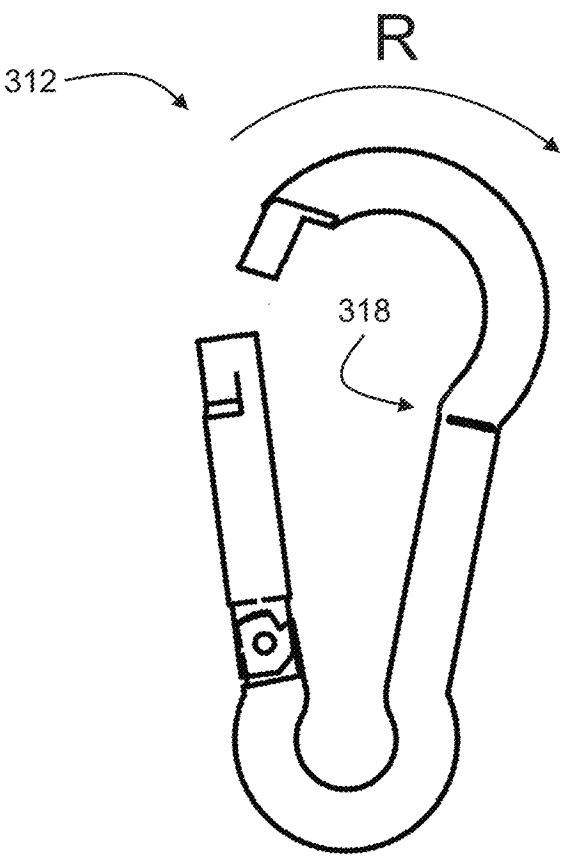

As shown in FIGS. 10A and 10B, as the rotation R continues, the stress $\sigma$ increases causing an increased strain €, and the bridge 318 experiences plastic deformation until it breaks. As stated above, by choosing appropriate dimensions (H1, W1) and positioning (D1) of the slot 316 and the corresponding dimensions of the bridge 318 (W2), the releasable attachment mechanism 312 may be designed to predictably break open with the application of a known breaking force $F_B$. For example, in some embodiments, for a side arm 310 with a diameter W3 of 0.305"-0.309" (and preferably about 0.306") and a breaking force $F_B$ of 350 #-430 #(and preferably about 388 #), the height H1 of the slot 316 may be chosen to equal 0.012"+/−0.002" and the width W1 of the slot 316 may be chosen to equal 0.247"+/−0.008". This may result in a bridge width W2 equal to about 0.057"+/−0.004". Looking at this in another way, the height H1 of the slot 316 may be about 4% the diameter W3 of the arm 310, and the width W1 of the slot 316 may be about 81% of the diameter W3 of the arm 310. This may result in the width W2 of the bridge being about 19% of the diameter W3 of the arm 310.

In another example, the slot 316 may be positioned at a vertical distance D1 below the point of force of about 0.620".

It is understood that these example slot dimensions and/or slot position(s) are meant for demonstration and that other dimensions and/or positions of the slot 316 also may be chosen, and that the scope of the releasable attachment mechanism 312 and that of the system 10 is not limited in any way by the chosen dimensions and/or positioning of the slot 316. In some embodiments, the slot dimensions and/or slot position(s) may result in different breaking forces $F_B$ depending on the material(s) used to form the mechanism 312 (e.g., the arm 310 with which the weakening element 314 may be configured). For example, for an arm 310 comprising stainless steel, the slot dimensions and/or slot position(s) shown above may result in a breaking force $F_B$ of about 388 #.

It is understood by a person of ordinary skill in the art that the descriptions above regarding the forces F1, F2, $F_T$ and/or $F_B$ applied to the releasable attachment mechanism 312 and the resulting torque $\tau$, force $F_{TS}$, stress $\sigma$, strain $\epsilon$ and eventual breakage of the releasable attachment mechanism 312 are meant for demonstration, and that other forces may be applied to the mechanism 312 that may result in other eventual breakages of the mechanism 312 as required for the mechanism 312 to fulfill its break-away functionalities within the system 10. It is also understood that the analysis and modeling of the mechanism 312, the weakening element 314 and/or other elements of the mechanism 312 and the forces described as shown above are meant to provide an understanding of the mechanism 312 and its functionalities, and that other analysis and/or modeling of the mechanism 312 may also be used.

In some embodiments, the shape and form of the weakening element 314 may include other architectures that may result in the same or similar results. For example, the weakening element 314 may include two or more slots 316 in close proximity on the arm 310 or spaced at distances along the arm 310. The two or more slots 316 may be positioned on the same side of the arm 310 (e.g., on the outside as shown in other embodiments) or on different sides (e.g., directly opposing one another on opposing sides and/or vertically offset on opposing sides). In another example, the weakening element 314 may include one or more slots 316 on the lateral sides of the arm 310 (e.g., perpendicular to or at other angles with respect to the slot 316 of FIG. 7B). In other examples, the angle of the slot 316 with respect to the arm 310 may include a non-perpendicular angle (e.g., diagonal). In another example, the slot 316 may not include a constant height H1 but may instead include a tapering height that tapers from a larger height at the opening of the slot 316 to a smaller height at the bridge 318 (e.g., wedge-shaped). In another example, the weakening element 314 may include one or more holes that pass through at least a portion of the arm 310. In this example, the one or more holes may result in the formation of one or more corresponding bridge portions associated with each hole.

Figure 11B:
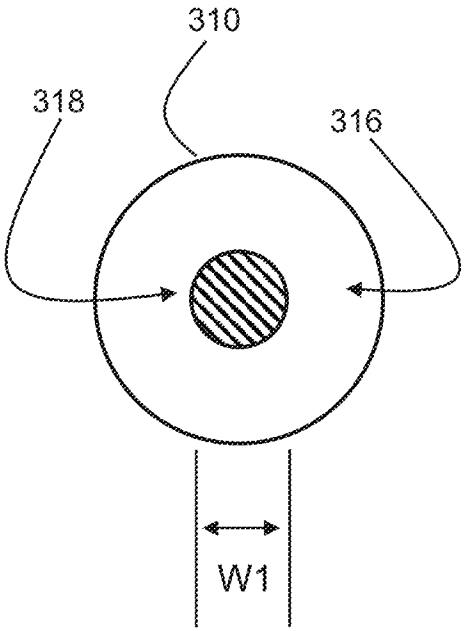
FIGS. 11A-11B show aspects of a weakening element according to exemplary embodiments hereof.
Figure 11A:
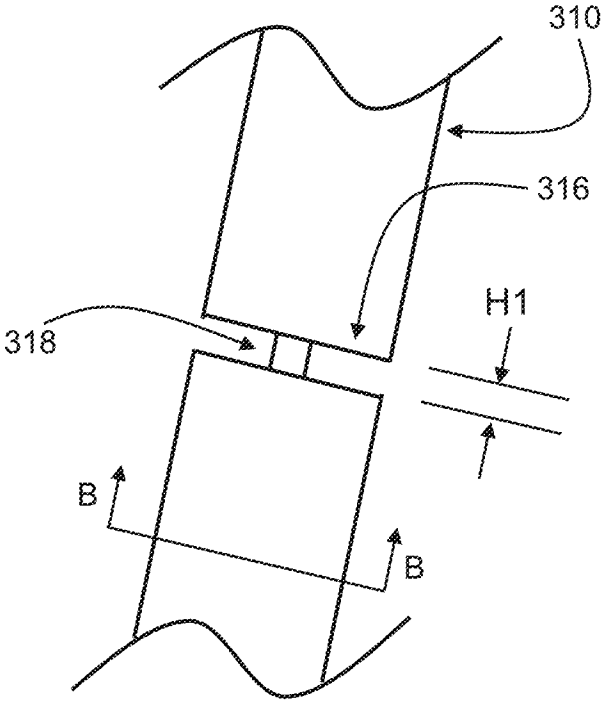

In yet another embodiment as shown in FIG. 11A, the slot 316 may include a circumferential slot 316 that extends inward from around the circumference of the arm 310 with a resulting bridge 318 generally positioned in the center of arm's cross-section as shown in FIG. 11B. Other slot architectures may also be used.

It is understood that the weakening element 314 may include any type(s) of element(s) and/or structure(s) that may generally weaken the mechanism's arm 310 so that the arm 310 may break under a defined load. It is also understood that the scope of the releasable attachment mechanism 312 and that of the system 10 is not limited in any way by the type(s), shape(s), form(s), location(s) and/or any other characteristics of the weakening element 314 that the releasable attachment mechanism 312 may employ.

Figure 12:
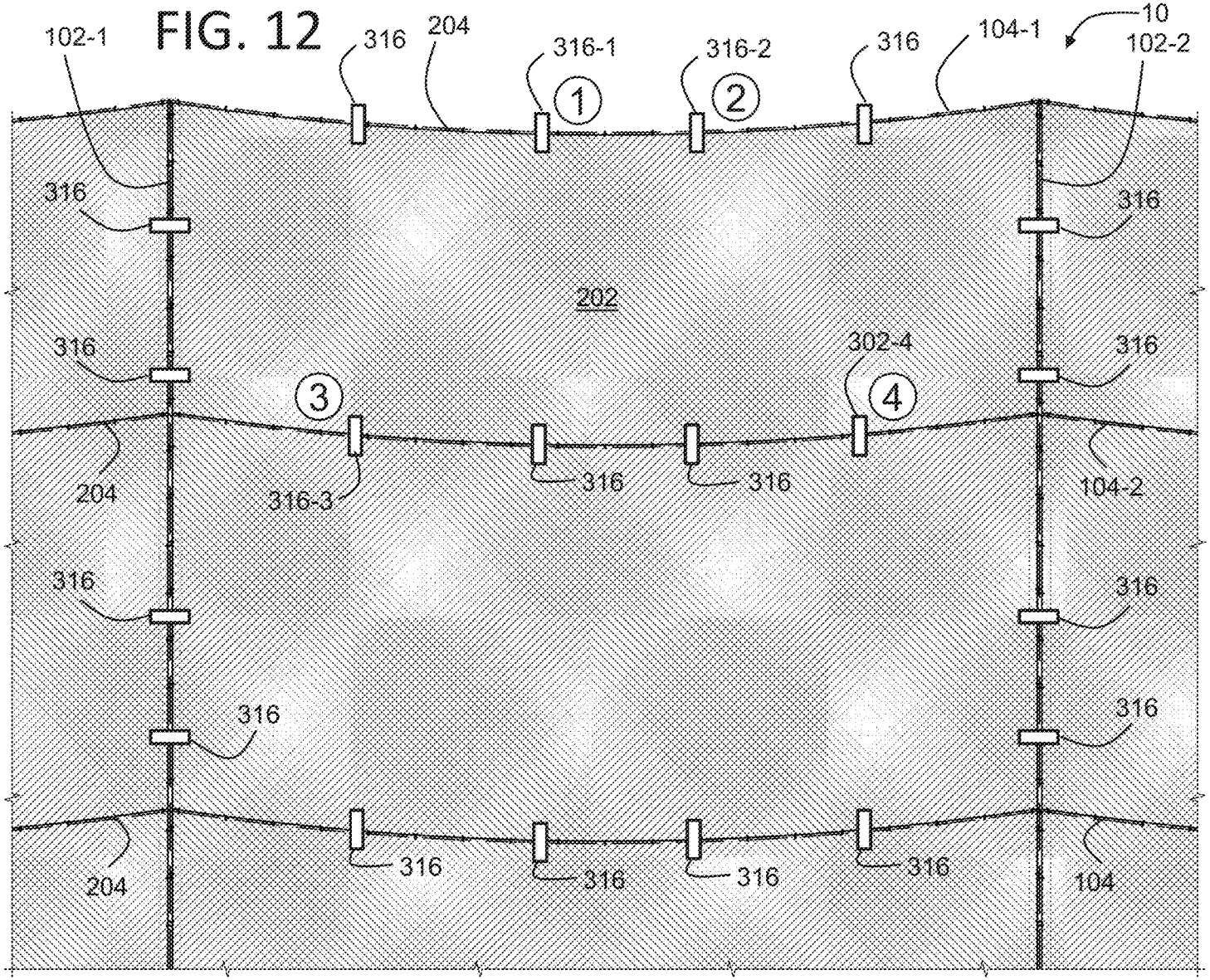
FIG. 12 depicts a close-up view of aspects of the netting system of FIG. 1.

In on exemplary embodiment hereof as shown in FIG. 12, the attachment mechanisms of FIG. 2 may each include releasable attachment mechanisms 316. For example, first attachment mechanism 302-1 may include a releasable attachment mechanism 316-1, the second attachment mechanism 302-2 may include a releasable attachment mechanism 316-2, the third attachment mechanism 302-3 may include a third releasable attachment mechanism 316-3 and the fourth attachment mechanism 302-4 may include a fourth releasable attachment mechanism 316-4. It is understood that the number and location of the releasable attachment mechanisms 316 shown in FIG. 12 are meant for demonstration and that the system 10 may include any number of releasable attachment mechanisms 316 as necessary.

In one exemplary embodiment hereof, by designing the releasable attachment mechanism 312 to release (e.g., break away) under predictable load conditions of a known breaking force $F_B$, the system 10 may be designed to include a specific number of releasable attachment mechanisms 312 placed at specific positions within the system 10 so that the releasable attachment mechanisms 312 may release a net 202 given specific environmental load conditions. Note that the number and/or placement of the attachment mechanisms 312 may be site specific as each site of the system 10 may include different potential environmental load conditions under which the system 10 may preferably perform.

For example, in some implementations, the releasable attachment mechanisms 312 may be used to connect the netting 202 to the upper lateral support 104 and/or intermediate lateral support at intervals of approximately 36". The releasable attachment mechanisms 312 also may be used to connect the netting 202 to the upright support structures 102 (or to vertical support cables configured with the upright support structures 102) at intervals of approximately 36". In other implementations, the releasable attachment mechanisms 312 may be placed at non-symmetrical spacings. It is understood that other placement positions and/or intervals of placement also may be used depending on the design of the releasable attachment mechanism 312, the application of the system 10 and/or the environment within which the system 10 may be installed, and that the scope of the system 10 is not limited in any way by the positioning and/or the placement intervals at which the releasable attachment mechanisms 312 may be configured.

It is understood that any aspect and/or element of any of the embodiments described herein or otherwise may be combined in any way to form new embodiments easily understood by a person of ordinary skill in the art. Those of ordinary skill in the art will appreciate and understand, upon reading this description, that embodiments hereof may provide different and/or other advantages, and that not all embodiments or implementations need have all advantages.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

What is claimed is:

1. A breakaway attachment mechanism comprising:

a generally C-shaped body member including a first free end and a second free end curved towards one another and separated by an opening, a portion of the body member generally opposite the opening including a first side facing the opening, a second side opposite the first side, a third side extending between the first side and the second side, and a fourth side opposite the third side and extending between the first side and the second side;

a gate member mounted at the second free end and being pivotable between a closed position and an open position;

a slot in the second side defined by a slot first surface and a slot second surface opposite the slot first surface, the slot first surface and the slot second surface extending from the second side and terminating into a slot backside at a first location between the second side and the first side and extending from the third side to the fourth side, the slot first surface parallel and mirroring the slot second surface from the second side to the first location;

wherein the body member will break at the slot when under a force of a predetermined magnitude.

2. The breakaway attachment mechanism of claim 1 wherein the slot first surface and the slot second surface are orthogonally separated by a slot height, and the slot height is 0.012"+/−0.002".

3. The breakaway attachment mechanism of claim 2 wherein the slot height is equal to about 4% of the distance between the first side and the second.

4. The breakaway attachment mechanism of claim 1 wherein a distance along the slot first surface from the second side to the first location is 0.2"-0.4".

5. The breakaway attachment mechanism of claim 1 wherein a distance along the slot first surface from the second side to the first location is 0.248"±0.025".

6. The breakaway attachment mechanism of claim 1 wherein a distance along the slot first surface from the second side to the first location is equal to about 78%-87% the distance between the first side and the second side.

7. The breakaway attachment mechanism of claim 1 wherein the body member will break at the slot when under a force of about 325 pounds or greater.

8. The breakaway attachment mechanism of claim 1 wherein the body member will break at the slot when under a force of about 388 pounds or greater.

9. The breakaway attachment mechanism of claim 1 wherein the generally C-shaped body member includes a first curved portion terminating at the first free end, and the slot is located about 0.6" from the first curved portion.

10. The breakaway attachment mechanism of claim 1 wherein the slot backside and the first side of the portion of the body member generally opposite the opening defines a slot bridge, and wherein the slot bridge breaks when the body member is under the force of the predetermined magnitude.

11. The breakaway attachment mechanism of claim 10 wherein a width of the slot bridge is 0.052"+/−0.01".

12. The breakaway attachment mechanism of claim 10 wherein a width of the slot bridge is equal to about 13%-22% the distance between the first side and the second side.

13. A breakaway attachment mechanism comprising:

a generally C-shaped body member including a first free end and a second free end curved towards one another and separated by an opening, a portion of the body member generally opposite the opening including a first side facing the opening, a second side opposite the first side, a third side extending between the first side and the second side, and a fourth side opposite the third side and extending between the first side and the second side;

a gate member mounted at the second free end and being pivotable between a closed position and an open position;

a collapsed slot in the second side defined by a slot first surface and a slot second surface opposite the slot first surface, the slot first surface and the slot second surface extending from the second side and terminating into a slot backside at a first location between the second side and the first side and extending from the third side to the fourth side, the slot first surface and the slot second surface separated at the slot backside by a slot height, the slot first surface oriented at a slot first surface angle with respect to the slot second surface from the slot backside to the second side such that the slot first surface physically contacts the slot second surface at the second side;

wherein a portion of the body member generally opposite the opening between the slot backside and the first side of the portion of the body member generally opposite the opening will break when under a force of a predetermined magnitude.

14. A self-releasing barrier netting system, said system comprising: a plurality of spaced apart generally vertical support structures;

at least one generally horizontal support structure attached to said vertical support structures;

a net adapted to be removably attached to said horizontal support structure to define a barrier of a predetermined height and width;

an attachment mechanism adapted for attaching said net to said horizontal support structure, said attachment mechanism comprising: a generally C-shaped body member including a first free end and a second free end curved towards one another and separated by an opening, a portion of the body member generally opposite the opening including a first side facing the opening, a second side opposite the first side, a third side extending between the first side and the second side, and a fourth side opposite the third side and extending between the first side and the second side; a gate member mounted at the second free end and being pivotable between a closed position and an open position; a slot in the second side defined by a slot first surface and a slot second surface opposite the slot first surface, the slot first surface and the slot second surface extending from the second side and terminating into a slot backside at a first location between the second side and the first side and extending from the third side to the fourth side, the slot first surface parallel and mirroring the slot second surface from the second side to the first location; wherein the body member will break at the slot when under a force of a predetermined magnitude.

* * * * *